United States Patent [19]

Wheeler

[11] 4,217,940

[45] Aug. 19, 1980

[54] FUNNEL HAVING AN INTEGRAL POURING SPOUT

[76] Inventor: Markham L. Wheeler, 6930 S. Columbia, Tulsa, Okla. 74136

[21] Appl. No.: 680,168

[22] Filed: Apr. 26, 1976

[51] Int. Cl.[2] ..... B65B 3/04

[52] U.S. Cl. ..... 141/98; 141/340; 222/192; 222/568

[58] Field of Search ..... 141/98, 331–345, 141/18, 2; 222/192, 460, 461, 462, 566–575

[56] References Cited

U.S. PATENT DOCUMENTS

| | | | |
|---|---|---|---|
| 111,525 | 2/1871 | Edwards | 141/342 |
| 1,000,150 | 8/1911 | Byrd | 141/98 |
| 2,230,180 | 1/1941 | Collins | 149/342 |
| 2,484,391 | 10/1949 | Treiss | 141/344 |
| 2,546,040 | 3/1951 | Murray | 141/341 |
| 2,811,181 | 10/1957 | Correll | 141/340 |

FOREIGN PATENT DOCUMENTS 7869 4/1901 United Kingdom .

*Primary Examiner*—Houston S. Bell, Jr.
*Attorney, Agent, or Firm*—Head & Johnson

[57] ABSTRACT

An improved funnel having an integral pouring spout, the apparatus including a base portion of a standard funnel configuration with an enlarged diameter open top and tapering downwardly to a small diameter open bottom, and a spout portion affixed to the tapered interior surface of the funnel base portion, the spout portion having an open bottom and sidewalls which converge upwardly and close to provide a passageway so that as the funnel is tipped in the direction of the spout portion fluid within the funnel is channeled by the sidewalls into the passageway, the funnel base portion having an integral cap affixed to the exterior lower end so that it may be threaded onto the externally threaded nozzle of a container, the funnel being thereby used to receive liquid poured into the container and subsequently used for pouring liquid out of the container.

2 Claims, 4 Drawing Figures

FUNNEL HAVING AN INTEGRAL POURING SPOUT

BACKGROUND AND OBJECTS OF THE INVENTION

Most containers for liquid have a small threaded opening. For example, gasoline cans, kerosine cans and so forth are usually provided with a relatively small opening. To pour liquid into such a container with a funnel is normally used. The present invention is directed towards a funnel which may be utilized for the dual purpose of facilitating the pouring of liquid into a container and subsequently used to pour liquid out of the same container.

The typical funnel is used when pouring liquid into a container and is then removed. A separate pouring spout is then attached to the container when it is necessary to pour out the contents. As an example, when a container is utilized to store gasoline for an internal combustion engine, such as a lawn mower, the gasoline is first poured into the container and subsequently a pouring spout is used to pour the gasoline from the container into the gas tank of the engine. In this invention a funnel is provided which can be attached to a container so that gasoline or any other liquid can be poured into the container and subsequently the same device is used to provide a pouring spout for pouring liquid from the container into some other receptacle having a small inlet opening, such as a gas tank.

It is therefore an object of this invention to provide an improved funnel.

More particularly, an object of this invention is to provide an improved funnel which performs the ordinary function but, in addition, has on the interior tapered funnel surface a pouring spout configured to convey liquid from within the funnel through a passageway when the funnel is tilted so as to discharge liquid through the passageway, the funnel including an integral cap portion by which it can be threaded onto a threaded nozzle of a container.

These objecs as well as other and more specific objects of the invention will be fulfilled in the following description and claims, taken in conjunction with the attached drawings.

DESCRIPTION OF VIEWS

SUMMARY OF THE INVENTION

An improved funnel is described which performs the normal purpose of a funnel, that is, it has an enlarged diameter open top base portion which tapers to a small diameter open discharge at the lower end, but in addition, includes an integral spout portion affixed to the interior surface of the funnel base portion, the spout portion having sidewalls which taper towards a passageway which extends above the upper open end of the funnel, the passageway serving to conduct fluid outwardly when the funnel is tilted in the direction of the spout portion, the funnel having a threaded cap affixed at the lower end so that the funnel may be threaded onto a container nozzle and thereby used both to receive ffluid poured into the container and for pouring fluid out of the container.

DETAILED DESCRIPTION

Figure 1:
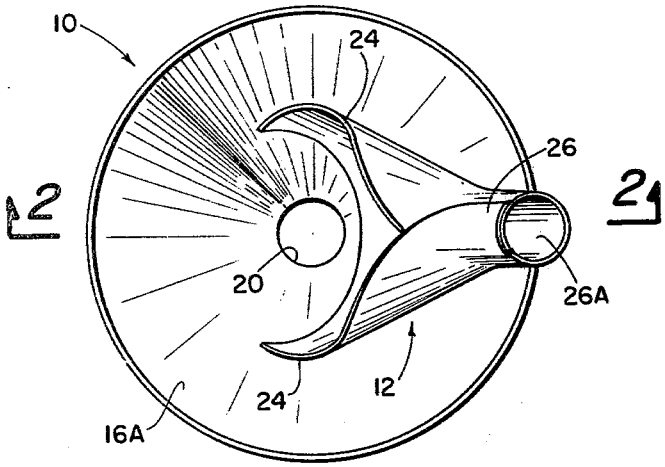
FIG. 1 is a top view of an improved funnel embodying the principles of this invention.
Figure 2:
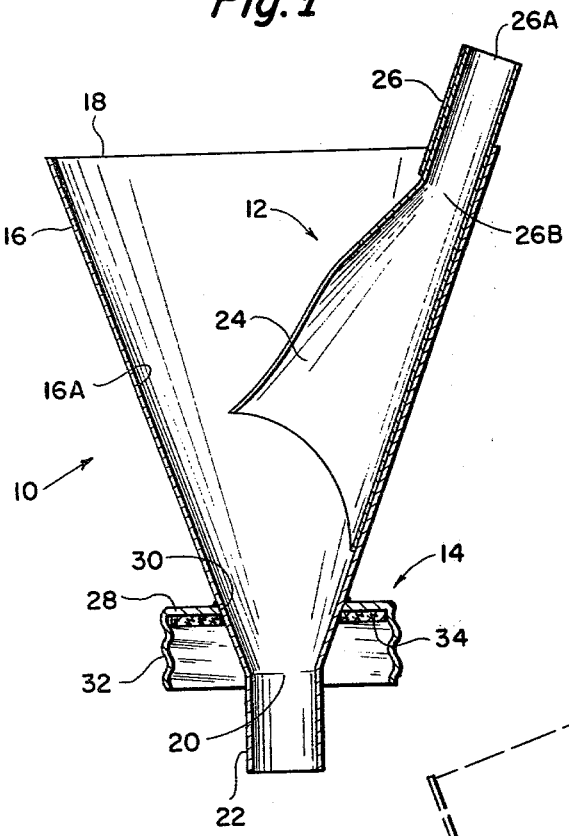
FIG. 2 is a cross-sectional view taken along the line 2—2 of FIG. 1.

Referring to the drawings and first to FIGS. 1 and 2, an improved funnel employing the principles of this invention is illustrated. The improved funnel includes three basic parts which are shown as separate items secured to each other but which may be integrally formed all in one piece, the three basic parts being a funnel base portion generally indicated by the numeral 10, a spout portion generally indicated by the numeral 12, and a cap generally indicated by the numeral 14.

The base portion 10 has an inverted frustoconical portion 16 having an enlarged diameter open top 18 and a reduced diameter open bottom 20. The funnel may also include, as illustrated, an integral downwardly extending passageway 22. The funnel base made up of integral portions 16 through 22 is a typical funnel arrangement. While it is shown of a conical configuration it can be seen it may be of any other shape providing a large open top 10 and small open bottom 20 to facilitate the pouring of fluid into a vessel having a small mouth.

Affixed to the interior surface 16A of the funnel base portion is the spout portion 12. This part includes opposed sidewalls 24 which flare outwardly and partially around the lower interior surface 16A and converge upwardly to a spout passageway 26. In the illustrated arrangement the sidewalls 24 and spout passageway 26 are all integrally formed of a single piece, such as of thin metal, bent into the illustrated shape and attached to the interior surface 16A of the funnel base portion such as by spot welding, soldering, brazing or the like. In addition, the components could be formed of plastic in which case the entire apparatus may be integrally cast of a single piece or the spout portion 12 affixed to the interior of the funnel base portion 10 such as by epoxy, solvent welding or the like.

The spout portion passageway 26 has an open top 26A and an open bottom 26B, the top 26A being above the open top 18 of the funnel base portion.

Cap 14 has a top 28 with an opening 30 therein which receives the lower end of funnel base portion 10 and is secured to it in a leakproof way, such as by soldering, welding, epoxy, solvent cement or the cap portion 14 may be integrally formed with the funnel base portion 10. Cap 14 has tubular sidewalls 32 which are threaded to engage the threaded nozzle (not shown) of a container so that the improved funnel may be attached to a container. Gasket 34 insures leakproof engagement of the cap 14 with the nozzle of a vessel.

Figure 3:
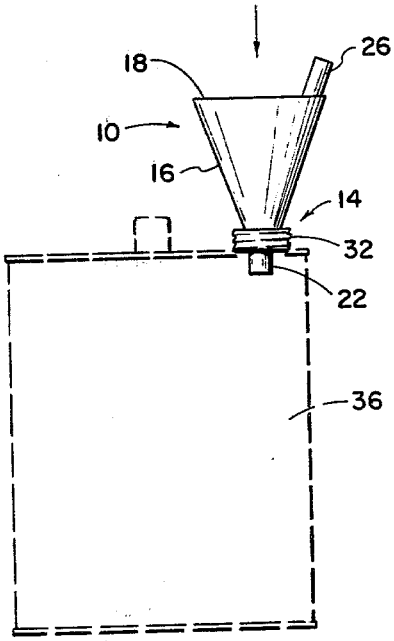
FIG. 3 is a view showing the improved funnel of this invention attached to a container by which liquid may be easily poured into the container.
Figure 4:
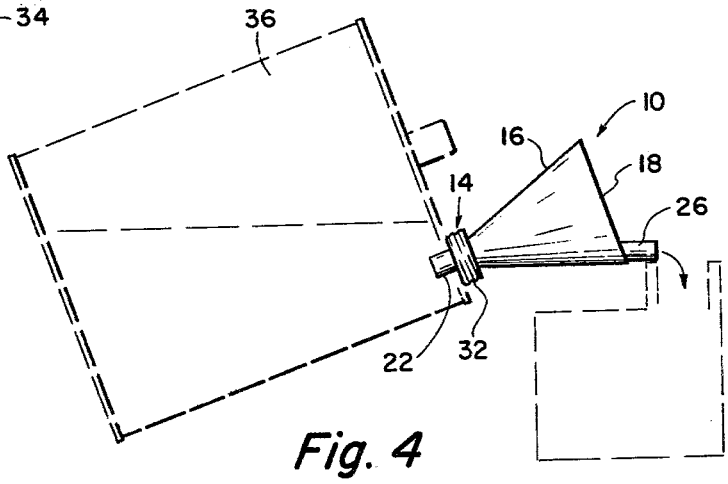
FIG. 4 is a view showing the funnel attached to the container of FIG. 3 and showing it being used to pour liquid out of the container.

FIGS. 3 and 4 show the means whereby the improved funnel of this invention may be used. In FIG. 3 the funnel is shown attached to the nozzle portion of a container 36, such as a gasoline container as would be utilized by the home owner to store gasoline used in a lawn mower. To pour gasoline or any other liquid into container 36 the funnel provides an easy means as any liquid poured into the upper open top 18 flows downwardly through the bottom open 20 and integral passageway 22 into the container. In this way the funnel of this invention functions like any other funnel with the exception that most known types of funnels are not provided with the cap portion 14 by which it is supported relative to container 16.

The novelty of this invention is the provision of the integral spout portion 12, only the upper passageway 26 of which is shown in FIGS. 3 and 4. When it is desired to pour out contents, container 36 is tilted in the direction of spout portion 26 and fluid within the container flows through the funnel lower opening 20 into the interior of the funnel body portion where it is channeled by the sidewalls 24, into passageway 26. Thus the device provides an integral pouring spout to easily pour liquid from the container into a small diameter opening, such as into the gas tank of a lawn mower.

As previously indicated, the specific configuration and the method of construction of the funnel described herein may vary considerably and in its final embodiment it may have an an appearance completely different from that illustrated herein. The funnel is shown here as being of a conical shape although it may be rectangular, triangular or other cross-sectional configurations. Spout portion 12 is illustrated as it is formed of thin sheet metal and obviously may take a variety of other configurations, particularly if molded of plastic.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed:

1. A funnel having an integral pouring spout comprising:

a base portion having a funnel configuration providing a large open top and tapering downwardly to a reduced dimensioned open bottom; and a spout portion affixed to the tapered interior surface of the base portion, the spout portion being open at the bottom and forming an open ended conduit at the top, the conduit terminating above the open top of said base portion, the bottom of the spout portion having spaced apart sidewalls flared outwardly and partially around the lower interior surface of the base portion, the sidewalls tapering towards the conduit to funnel fluid out of said base portion open bottom to said conduit when the funnel is tilted downwardly in the direction of the spout portion.

2. A funnel according to claim 1 including:

an open bottom cap having an axial opening in the top receiving the lower portion of said base portion, the bottom of the funnel base portion terminating below the cap top, the cap having internal threads whereby the funnel may be threadably positioned on the threaded nozzle of a container or the like.

* * * * *

US004217940B1

REEXAMINATION CERTIFICATE (2904th)

United States Patent [19] [11] B1 4,217,940

Wheeler [45] Certificate Issued Jun. 11, 1996

[54] FUNNEL HAVING AN INTEGRAL POURING SPOUT

[76] Inventor: Markham L. Wheeler, 6930 S. Columbia, Tulsa, Okla. 74136

Reexamination Request:
No. 90/003,960, Sep. 18, 1995

Reexamination Certificate for:

| | |
|---|---|
| Patent No.: | **4,217,940** |
| Issued: | **Aug. 19, 1980** |
| Appl. No.: | **680,168** |
| Filed: | **Apr. 26, 1976** |

[51] Int. Cl.[6] ..... B65B 3/04

[52] U.S. Cl. ..... 141/98; 141/340; 222/192; 222/568

[58] Field of Search ..... 141/2, 18, 98, 141/199–205, 297–300, 331–345; 222/192, 460–462, 566–575, 109

[56] References Cited

U.S. PATENT DOCUMENTS

| | | | |
|---|---|---|---|
| 111,525 | 2/1871 | Edwards | 141/342 |
| 1,000,150 | 8/1911 | Byrd | 141/98 |
| 1,794,098 | 2/1931 | Aulbach et al. . | |
| 2,230,180 | 1/1941 | Collins | 149/342 |
| 2,484,391 | 10/1949 | Treiss | 141/344 |
| 2,546,040 | 3/1951 | Murray | 141/341 |
| 2,601,039 | 6/1952 | Livingstone | 222/109 |
| 2,743,844 | 5/1956 | Livingstone | 222/111 |
| 2,811,181 | 10/1957 | Correll | 141/340 |
| 2,851,196 | 9/1958 | Livingstone | 222/111 |
| 3,434,637 | 3/1969 | Marcel | 222/570 |
| 3,833,150 | 9/1974 | Visser-Patings | 222/109 |
| 4,078,700 | 3/1978 | Hidding | 222/109 |

FOREIGN PATENT DOCUMENTS

| | | |
|---|---|---|
| 180000 | 10/1954 | Australia . |
| 188590 | 4/1937 | Switzerland . |
| 7869 | of 1901 | United Kingdom . |

*Primary Examiner*—Henry J. Recla

[57] ABSTRACT

An improved funnel having an integral pouring spout, the apparatus including a base portion of a standard funnel configuration with an enlarged diameter open top and tapering downwardly to a small diameter open bottom, and a spout portion affixed to the tapered interior surface of the funnel base portion, the spout portion having an open bottom and sidewalls which converge upwardly and close to provide a passageway so that as the funnel is tipped in the direction of the spout portion fluid within the funnel is channeled by the sidewalls into the passageway, the funnel base portion having an integral cap affixed to the exterior lower end so that it may be threaded onto the externally threaded nozzle of a container, the funnel being thereby used to receive liquid poured into the container and subsequently used for pouring liquid out of the container.

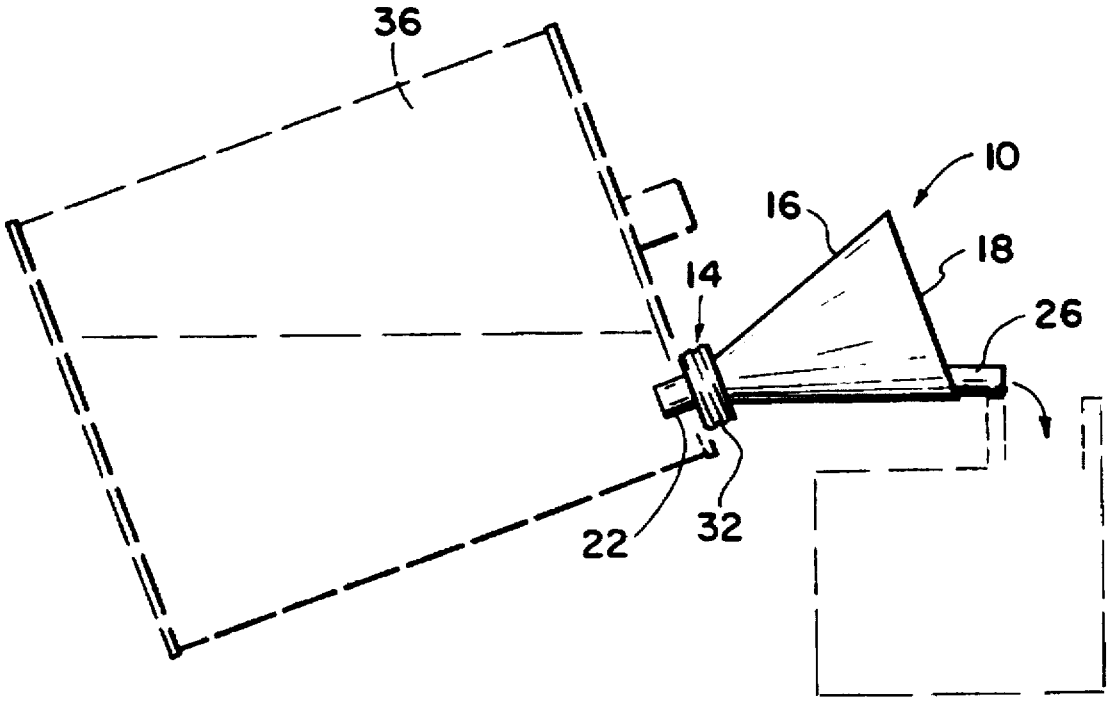

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2 is confirmed.

* * * * *

US004217940B2

REEXAMINATION CERTIFICATE (3547th)

United States Patent [19] [11] B2 4,217,940

Wheeler [45] Certificate Issued Jun. 16, 1998

[54] FUNNEL HAVING AN INTEGRAL POURING SPOUT

[75] Inventor: Markham L. Wheeler, 6930 S. Columbia, Tulsa, Okla. 74136

[73] Assignee: Markham L. Wheeler, Tulsa, Okla.

Reexamination Requests:
No. 90/004,207, Apr. 5, 1996
No. 90/004,210, Apr. 8, 1996

Reexamination Certificate for:

| | |
|---|---|
| Patent No.: | **4,217,940** |
| Issued: | **Aug. 19, 1980** |
| Appl. No.: | **680,168** |
| Filed: | **Apr. 26, 1976** |

Reexamination Certificate B1 4,217,940 issued Jun. 11, 1996

[51] Int. Cl.[6] ..... B65B 3/04

[52] U.S. Cl. ..... 141/98; 141/340; 222/192; 222/568

[58] Field of Search ..... 141/2, 18, 98, 141/199–205, 297–300, 331–345; 222/192, 460–462, 566–575, 109

[56] References Cited

U.S. PATENT DOCUMENTS

| | | | |
|---|---|---|---|
| 50,620 | 10/1865 | Parise et al. . | |
| 124,492 | 3/1872 | Jadwin . | |
| 137,139 | 3/1873 | Lang, Jr. . | |
| 1,626,050 | 4/1927 | Pratt . | |
| 1,794,098 | 2/1931 | Aulbach . | |
| 2,601,039 | 6/1952 | Livingstone | 222/109 |
| 2,601,040 | 6/1952 | Livingstone | 222/109 |
| 2,743,844 | 5/1956 | Livingstone | 222/111 |
| 2,763,403 | 9/1956 | Livingstone | 222/111 |
| 2,808,964 | 10/1957 | Radtke | 222/111 |
| 2,851,196 | 9/1958 | Livingstone | 222/111 |
| 3,434,637 | 3/1969 | Marcel | 222/570 |
| 3,628,697 | 12/1971 | Dowson | 222/111 |
| 3,833,150 | 9/1974 | Visser-Patings | 222/109 |
| 4,078,700 | 3/1978 | Hidding | 222/109 |

FOREIGN PATENT DOCUMENTS

| | | |
|---|---|---|
| 180000 | 10/1954 | Austria . |
| 382948 | 7/1974 | Japan . |
| 76733 | 11/1953 | Netherlands . |
| 188590 | 4/1937 | Switzerland . |
| 678883 | 9/1952 | United Kingdom . |

*Primary Examiner*—J. Casimer Jacyna

[57] ABSTRACT

An improved funnel having an integral pouring spout, the apparatus including a base portion of a standard funnel configuration with an enlarged diameter open top and tapering downwardly to a small diameter open bottom, and a spout portion affixed to the tapered interior surface of the funnel base portion, the spout portion having an open bottom and sidewalls which converge upwardly and close to provide a passageway so that as the funnel is tipped in the direction of the spout portion fluid within the funnel is channeled by the sidewalls into the passageway, the funnel base portion having an integral cap affixed to the exterior lower end so that it may be threaded onto the externally threaded nozzle of a container, the funnel being thereby used to receive liquid poured into the container and subsequently used for pouring liquid out of the container.

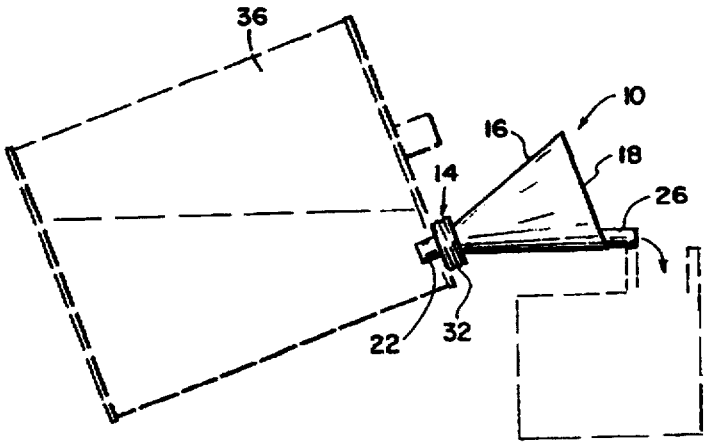

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2 are confirmed.

* * * * *